US010378799B2

(12) United States Patent
Andersson et al.

(10) Patent No.: US 10,378,799 B2
(45) Date of Patent: Aug. 13, 2019

(54) PORT OPENING WITH SUPERCOOLING

(71) Applicant: SWEP INTERNATIONAL AB, Landskrona (SE)

(72) Inventors: Sven Andersson, Hassleholm (SE); Tomas Dahlberg, Helsingborg (SE)

(73) Assignee: SWEP INTERNATIONAL AB, Landskrona (SE)

( * ) Notice: Subject to any disclaimer, the term of this patent is extended or adjusted under 35 U.S.C. 154(b) by 656 days.

(21) Appl. No.: 14/764,515

(22) PCT Filed: Feb. 14, 2014

(86) PCT No.: PCT/EP2014/052952
§ 371 (c)(1),
(2) Date: Jul. 29, 2015

(87) PCT Pub. No.: WO2014/125089
PCT Pub. Date: Aug. 21, 2014

(65) Prior Publication Data

US 2015/0362269 A1 Dec. 17, 2015

(30) Foreign Application Priority Data

Feb. 14, 2013 (SE) ..... 1350173

(51) Int. Cl.
*F25B 39/02* (2006.01)
*F25B 39/04* (2006.01)
(Continued)

(52) U.S. Cl.
CPC ..... *F25B 39/022* (2013.01); *F25B 39/04* (2013.01); *F25B 40/00* (2013.01); *F28D 9/005* (2013.01);
(Continued)

(58) Field of Classification Search
CPC ..... F28F 9/028; F28F 9/027; F25B 41/062; F25B 2500/18; F25B 39/022;
(Continued)

(56) References Cited

U.S. PATENT DOCUMENTS 2,195,228 A 3/1940 Schwarz
4,809,518 A 3/1989 Murayama
(Continued)

FOREIGN PATENT DOCUMENTS

EP 2174810 4/2010
EP 2174810 A2 4/2010
(Continued)

OTHER PUBLICATIONS

International Search Report for International Application No. PCT/EP2014/052952 dated May 16, 2014 (2 pages).
(Continued)

*Primary Examiner* — Tho V Duong
(74) *Attorney, Agent, or Firm* — Merchant & Gould P.C.

(57) ABSTRACT

A plate heat exchanger (100) comprises a number of plates (110) provided with a pressed pattern of ridges (R) and grooves (G) arranged to keep the plates (110) on a distance from one another under formation of interplate flow channels for media to exchange heat. The interplate flow channels communicate with port openings (A, B, C, 140) being in selective communication with said interplate flow channels, one of the port openings (140) providing for connection to a downstream side of an expansion valve (EXP) such that coolant from the expansion valve (EXP) may enter the interplate flow channels communicating with the one port opening (140). A heat exchanging means (160, 165, 150, 155; HEP, LC, DP) is provided inside the one port opening (140), said heat exchanging means (160, 165, 150, 155; HEP, LC, DP) being arranged for exchanging heat between
(Continued)

coolant downstream the expansion valve (EXP) and coolant about to enter the expansion valve (EXP).

11 Claims, 9 Drawing Sheets

(51) Int. Cl.
*F28F 27/02* (2006.01)
*F28D 9/00* (2006.01)
*F25B 40/00* (2006.01)
*F28F 9/02* (2006.01)

(52) U.S. Cl.
CPC ..... *F28D 9/0037* (2013.01); *F28D 9/0093* (2013.01); *F28F 9/026* (2013.01); *F28F 27/02* (2013.01)

(58) Field of Classification Search
CPC .... F25B 39/028; F28D 1/0341; F28D 1/0333; F28D 1/0308; F28D 1/0325
See application file for complete search history.

(56) References Cited

U.S. PATENT DOCUMENTS 5,505,060 A * 4/1996 Kozinski ..... F25B 39/022 165/132
9,093,729 B2 * 7/2015 Wesner ..... B60H 1/00
2008/0190595 A1 8/2008 Sjodin et al.
2010/0214090 A1 * 8/2010 Sartini ..... H04L 12/581 340/517
2012/0210746 A1 8/2012 Kadle et al.
2015/0000327 A1 1/2015 Kakehashi et al.

FOREIGN PATENT DOCUMENTS

JP S52-48153 U 4/1977
JP H05-149651 A 6/1993
JP H11-125464 A 5/1999
JP 2001-012811 A 1/2001
JP 2011-503509 A 1/2011
JP 2012-512379 A 5/2012
JP 2012-512381 A 5/2012
WO WO9414021 * 6/1994
WO WO 97/00415 1/1997
WO WO 02/01124 1/2002
WO WO 2005/054758 6/2005
WO WO 2009/062738 5/2009
WO WO 2010/069872 6/2010
WO WO 2010/069873 6/2010
WO WO 2010/069874 6/2010
WO WO 2013/114880 A1 8/2013

OTHER PUBLICATIONS

U.S. Appl. No. 14/764,515 entitled "Port Opening with Supercooling", filed Jul. 29, 2015 and assigned to Swep International AB.

* cited by examiner

PORT OPENING WITH SUPERCOOLING

This application is a National Stage Application of PCT/EP2014/052952, filed 14 Feb. 2014, which claims benefit of Serial No. 1350173-9, filed 14 Feb. 2013 in Sweden and which applications are incorporated herein by reference. To the extent appropriate, a claim of priority is made to each of the above disclosed applications.

FIELD OF THE INVENTION

The present invention relates to a port opening arrangement of an evaporator comprising a number of plates held on a distance from one another under formation of interplate flow channels for media to exchange heat. The port opening is in selective communication with said interplate flow channels and provides for connection to a downstream side of an expansion valve such that coolant from the expansion valve may enter the interplate flow cannels communicating with the port opening.

PRIOR ART

Heat pumps for domestic or district heating generally comprises a compressor compressing a gaseous coolant and a condenser wherein compressed gaseous coolant exchanges heat with a heat carrier of e.g. a heating system for a house, such that the coolant condenses. After the coolant has been condensed, it will pass an expansion valve, such that the pressure (and hence the boiling point) of the coolant decreases. The low-pressure coolant then enters an evaporator, wherein the coolant is evaporated under heat exchange with a low-temperature heat carrier, e.g. a brine solution collecting heat from the ground or outside air.

The basic function of the heat pump system as disclosed above is very simple, but in reality, and to achieve the maximum performance, complications will arise.

One example of a phenomenon that will complicate matters is that the temperature differences will differ significantly over time; during winter or heating of heated tap water, it is necessary to condense the coolant at a high temperature, and the brine solution, i.e. the energy carrier used to evaporate the coolant, may be cold, while there might be other temperature levels during springtime and autumn. Usually, adapting the system to different temperatures may be achieved by controlling the pressure differences by controlling the expansion valve and the compressor. It is, however, not possible to vary the heat exchangers, meaning that those must be designed for a "worst case scenario". Generally, bigger is always better, but at some point, the cost of the heat exchangers will be too high.

One major problem with a too small a heat exchanger for condensing gaseous coolant is that not all of the coolant will be condensed as it leaves the condenser. Having uncondensed coolant leaving the condenser is very detrimental to the heat pump process, since uncondensed coolant makes it very hard to control the expansion valve. A common way of circumventing this problem is to provide a suction gas heat exchanger exchanging heat between condensed coolant from the condenser and evaporated coolant leaving the evaporator (generally referred to as "suction gas"). The heat exchanger used for the suction gas heat exchanger is generally very small, it is often sufficient to braze or solder a pipe leading to the expansion valve to the pipe leading the suction gas to the condensor in order to achieve the required heat exchange.

Even if the liquid coolant from the condenser should be totally liquid, it might be advantageous to supercool it far below its boiling point at the pressure upstream the expansion valve. As well known, some the coolant will boil immediately after the expansion valve. This boiling will take its energy from the temperature of the liquid coolant. By supercooling the liquid coolant about to enter the expansion valve, the amount of liquid transforming into gas phase immediately after the expansion valve may be reduced significantly.

This reduction in boiling of coolant immediately downstream the expansion valve has some very positive effects; it is a well known problem that the gas in the coolant increases the volume of the coolant considerably, such that connection pipes of a large diameter must be used and also that the distribution of the coolant in the evaporator can be disturbed by the gaseous content.

It is an object of the invention to provide solutions for supercooling of the liquid coolant entering the expansion valve, such that the above problems concerning distribution and increased pressure drop may be mitigated.

It is also an object of the invention to provide a port arrangement allowing for a heat exchange increasing the stability of a heat pump cycle.

SUMMARY OF THE INVENTION

The present invention solves this and other problems by providing a port opening of an evaporator, where a heat exchanging means is provided inside the port opening, said heat exchanging means being arranged for exchanging heat between coolant downstream the expansion valve and coolant about to enter the expansion valve.

For example, the heat exchanging means inside the port opening may be a pipe extending through the port opening. The pipe may extend from one end of the port to the other.

In order to facilitate manufacturing of the evaporator, the heat exchanging means may be provided by a pressed pattern in the heat exchanger plates.

BRIEF DESCRIPTION OF THE DRAWINGS

In the following, embodiments of the invention will be described with reference to the appended drawings, wherein.

DESCRIPTION OF EMBODIMENTS

Figure 1:
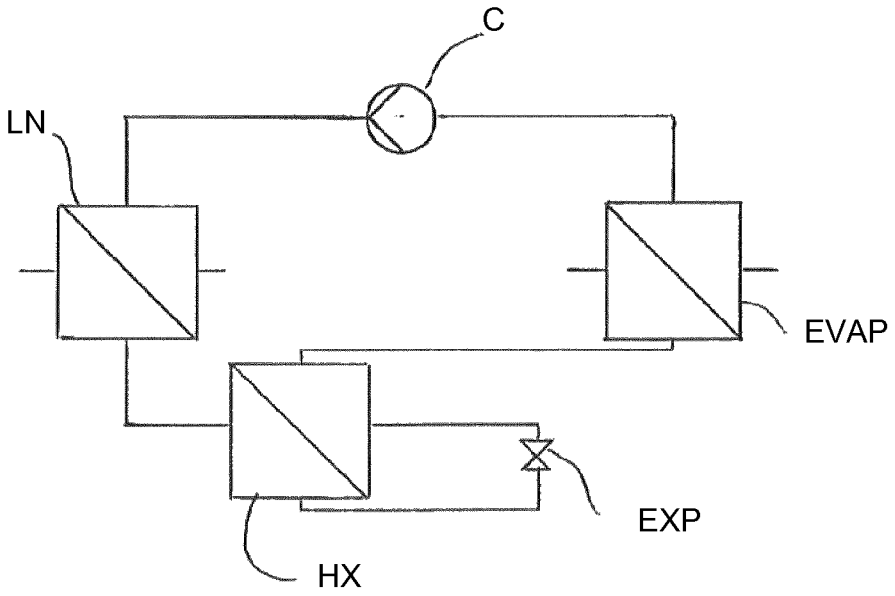
FIG. 1 is a schematic view of a heat pump or cooling system according to the prior art.

In FIG. 1, an exemplary heat pump or cooling system utilizing an evaporator having a port opening arrangement according to the present invention is shown. The system comprises a compressor C, compressing gaseous coolant such that the temperature and pressure of the coolant increases, a condenser CN condensing the gaseous coolant by exchanging heat between the coolant an a high temperature heat carrier, e.g. water for domestic heating, a shortcircuit heat exchanger HX, wherein the temperature of the liquid coolant from the condenses CN decreases by exchanging heat with semi-liquid coolant from an expansion valve EXP. The coolant after the expansion valve will have a low temperature due to partial boiling due to the pressure decrease after the expansion valve. Finally, the semi-liquid coolant will enter an evaporator EVAP, in which the semi-liquid will evaporate by exchanging heat with a low temperature heat carrier, e.g. a brine solution collecting the low temperature heat from e.g. a ground source and/or ambient air.

Typical temperatures for the high temperature heat carrier and the low temperature heat carrier are 50° C. and 0° C., respectively. Hence, the temperature of the liquid coolant leaving the condenser CN will have a temperature exceeding 50° C., and the coolant leaving the expansion valve EXP will have a temperature falling below 0° C.

As could be understood, the gas content of the coolant leaving the expansion valve will be significantly lower than in a heat pump cycle without the shortcircuit heat exchanger HX, since the temperature of the liquid coolant entering the expansion valve EXP will be lower. However, in the configuration of FIG. 1, the gas content of the semi-liquid leaving the short-circuit heat exchanger HX and entering the evaporator EVAP will be identical to the gas content in a semi liquid coolant entering an evaporator in a heat pump system without the short-circuit heat exchanger. Hence, a system according to FIG. 1 will give no effect on the distribution of coolant in the evaporator, which is one of the objectives of the present invention.

Figure 2:
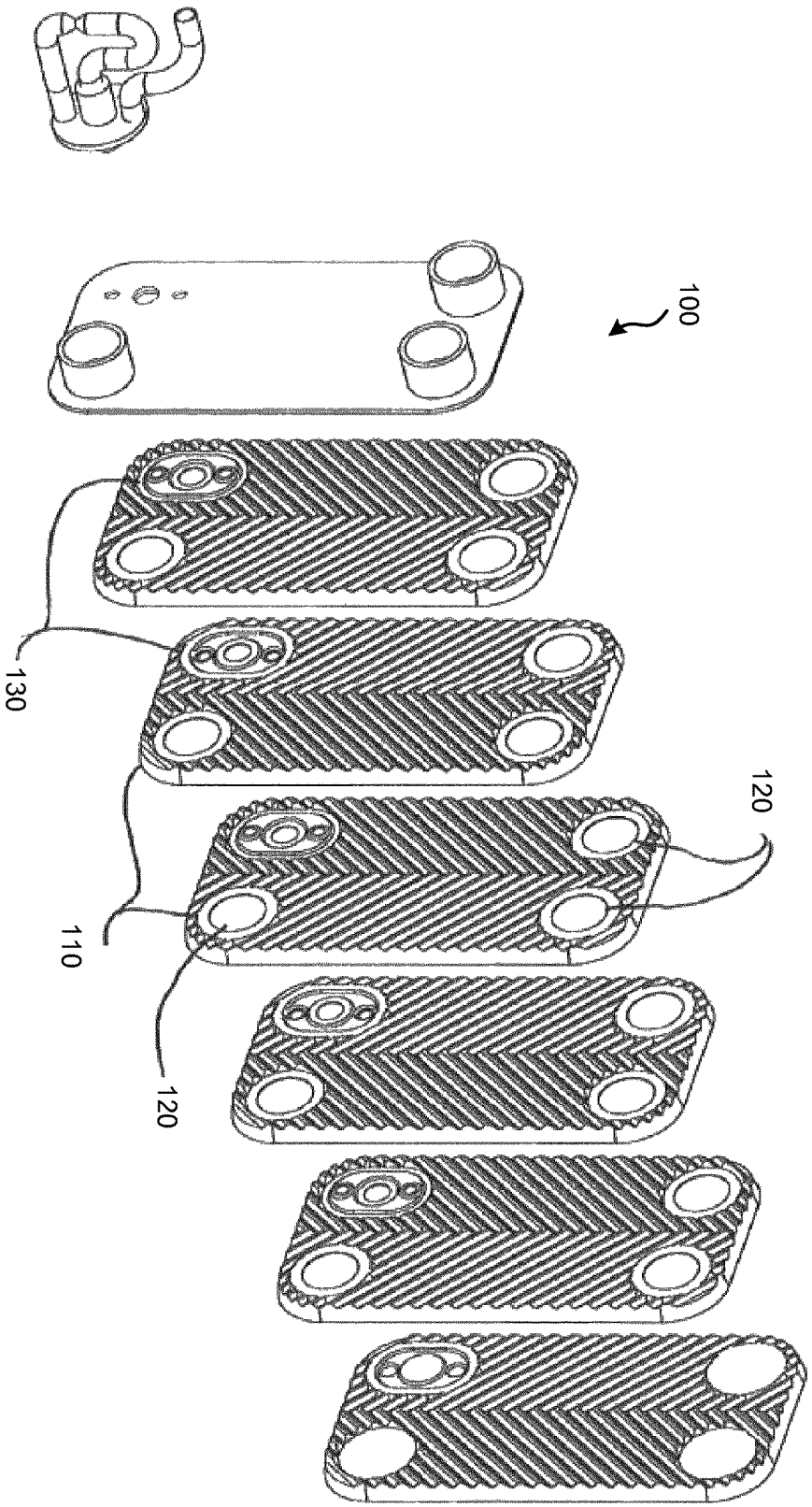
FIG. 2 is an exploded perspective view showing a number of heat exchanger plates comprised in a heat exchanger according to one embodiment of the invention.

With reference to FIG. 2, an evaporator 100 according to one embodiment of the present invention comprises a number of heat exchanger plates 110, each being provided with a pressed pattern of ridges R and grooves G adapted to keep the plates on a distance from one another for the formation of interplate flow channels for media to exchange heat. Port areas 120 of the heat exchanger plates 110 are surrounded by plate areas being provided on different heights in order to provide for selective communication between the ports and the interplate flow channels, in a way well known by persons skilled in the art.

Figure 3:
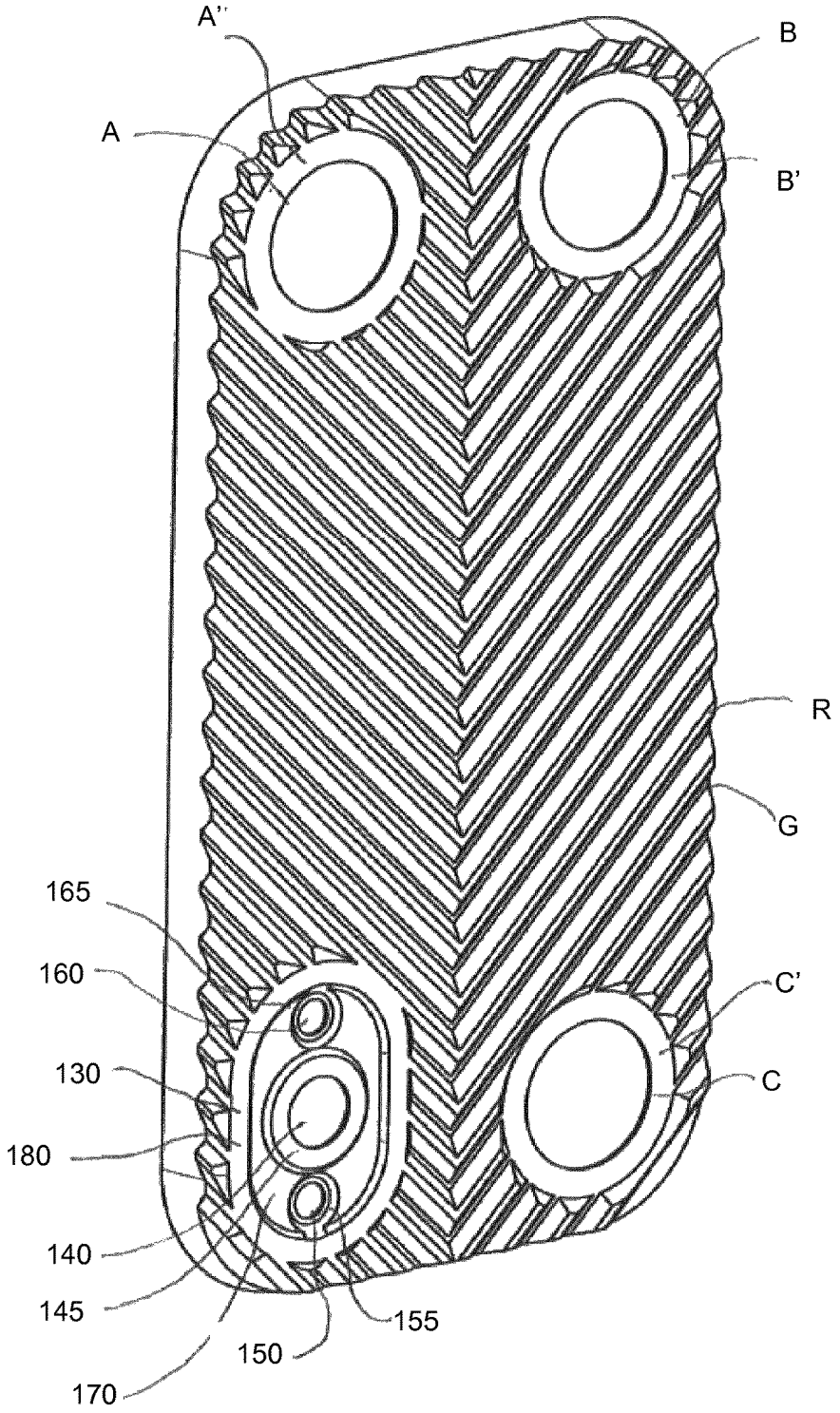
FIG. 3 is a perspective view of one of the heat exchanger plates shown in FIG. 2, in a larger scale.

With reference to FIG. 3, which shows a port area of a heat exchanger plate 110 of FIG. 2, an inlet port area 130 comprises an inlet 140 for semi-liquid coolant directly from the expansion valve EXP (meaning that there is no heat exchange of the coolant between the expansion valve and the inlet), and two ports 150, 160 for letting in and letting out liquid coolant from the condenser CN and to the expansion valve EXP, respectively.

In order to form an evaporator, the plates 110 are stacked in a stack, such that the ridges and grooves contact one another and keep the plates on a distance from one another. In a preferred embodiment, the stack of plates is placed in a furnace with brazing material between the plates, such that the plates are brazed together in contact points between neighboring plates.

Again with reference to FIG. 3, it is shown that a ringlike area 145 surrounding the port opening 140 is provided on a high level (equal to the level of the ridges R, whereas ringlike areas 155 and 165 surrounding the ports 150, 160, respectively, are provided on a low level (equal to the level of the grooves G). An intermediate area 170, which in the shown embodiment extends around the port opening 140, and its surrounding ringlike area, is placed on an intermediate level between the high and low levels. Finally, the intermediate area 170 is surrounded by a blocking area 180, which is provided on the high level, just like the ridges R and the ringlike area 145.

Moreover, openings A, B and C are surrounded by areas A', B' and C', which are provided on high, low and low heights, respectively, are provided near corners of the plate.

When the plate shown in FIG. 3 is placed in a stack, it is neighbored by plates having mirrored heights around the port openings, i.e. such that the ringlike areas 155, 165 are placed on the high level, the ringlike area 145 is placed on a low level and the areas A', B' and C' are placed on low, high and high levels, respectively.

Thus, the following flow channels are formed: Above the plate shown in FIG. 3, there will be a flow channel for e.g. brine solution between the port openings C and B. This flow channel will extend over almost all the area of the plate, but will be blocked from communication with the intermediate area 170 by the blocking area 180. Moreover, there will be a communication between the port openings 150 and 160 over the intermediate area 170.

On the other side of the plate shown in FIG. 3, there will be a communication between the port opening 140 and the port opening A via the interplate flow channel defined by these two plates. This flow channel will extend all over the plate area, including the intermediate area 170.

This embodiment makes it possible to achieve a supercooling of the liquid coolant from the condenser before it enters the expansion valve by letting in hot liquid coolant from the condenser into any of the ports 160 or 150, let supercooled coolant out from the other of the ports 150 or 160, and let semi-liquid coolant from the expansion valve in through the port 140. By this arrangement, there will be a heat exchange between the incoming cool semi liquid coolant from the expansion valve and the incoming hot liquid coolant from the condenser. It is important to notice that this heat exchange takes place after the semi-liquid coolant has been distributed along the height of the stack of heat exchanger plates. Hence, the increased gas content resulting from the heat exchange with the hot liquid coolant from the condensor will not disturb the distribution of fluid.

It should be noted that the intermediate area 170 does not have to extend around the port opening 140. In one embodiment of the invention, the intermediate area may run from the long side of the plate and the short side of the plate in a crescent moon fashion, hence partly encircling the port opening.

The evaporators described above may further be equipped with any known means for improving the distribution of semiliquid coolant, e.g. a distribution pipe according to EP 08849927.2.

The evaporator according to the above also makes it possible to use a novel heat pump system.

In a prior art system, all, or virtually all, of the pressure drop between the condenser and the evaporator takes place over the expansion valve, which usually may be controlled for adapting the system to various temperature and heating requirements. As mentioned above, it is possible to supercool the liquid coolant from the condenser such that considerably less coolant vaporizes immediately after the expansion valve. However, this benefit is counteracted in the prior art systems due to the temperature rise of the semi liquid coolant from the expansion valve in the supercooler HX, which temperature rise will create gas phase coolant after the supercooler. Consequently, no distribution benefits will be earned according to the prior art solution.

In a system using the evaporator according to the embodiment of FIGS. 2 and 3, it is possible to further improve the distribution by providing a two-step expansion (or, in an ideal case, a first controllable pressure reducing step over the expansion valve and a second expansion step over the distribution pipe—please note that expansion over a pressure reducing valve comes from partial evaporation. A liquid with a temperature lower than the boiling temperature of the liquid after pressure reduction will not expand significantly after a pressure reduction—neither will its temperature drop).

This system will be explained below:

Imagine a distribution pipe according to e.g. EP08849927.2, which is a distribution pipe comprising an elongate pipe provided with a multitude of small holes aligned with the plate interspaces into which it is desired to feed coolant to be evaporated, wherein the small holes have such a dimension that they will give a sufficient pressure drop in operating conditions of a maximum mass flow and minimal temperature difference between the temperature of the condenser and the temperature of the evaporator. In such an operating condition, there will be liquid only entering the distribution pipe, since the expansion valve will be completely open, and the expansion, after which there will be some gas in the liquid, will take place after the coolant has been properly distributed over the length of the distribution pipe.

It is of course desired to have a system where the pressure drop between the condenser and the evaporator can be controlled, and this can be achieved by putting an ordinary expansion valve upstream the distribution pipe, and here, one of the most important advantages with the present invention compared to the prior art solution can be found: The supercooling between the liquid entering the expansion valve and the liquid leaving the distribution pipe takes place after the distribution pipe has distributed the coolant along the length of the distribution pipe. Hence, the increase of gas phase coolant will not disturb the distribution. In the prior art solution according to FIG. 1, there will be just as much gas being fed into the distribution pipe as it would have been without heat exchange between the coolant form the condenser and the coolant from the expansion valve, since the reduction of gas in the coolant from the expansion valve will be counteracted by the increase of gas in the coolant entering the heat exchanger from the expansion valve.

Moreover, there will be a stability benefit not attainable by the prior art systems: imagine a situation where it is desired to have a larger pressure drop between the condenser and the evaporator. This can be achieved by controlling the expansion valve such that a partial pressure drop takes place over the expansion valve. Without supercooling, or with supercooling in a supercooler HX according to FIG. 1, reducing the pressure over the expansion valve will cause large amounts of gaseous coolant entering the distribution pipe. As well known, a certain mass flow of gas over a restriction (in this case the holes along the length of the distribution pipe) gives a much larger pressure drop than an equal mass flow of liquid flowing over the same restriction. Consequently, such a system utilized on a prior art system will be very difficult to control.

If used in conjunction with an evaporator according to FIGS. 2 and 3, however, this problem is significantly mitigated: Due to the supercooling AND the fact that the heat exchange between the liquid coolant to the expansion valve and the liquid after the pressure drop in the expansion valve and in the distribution pipe, there will be significantly less gas phase coolant in the distribution pipe, hence increasing the controllability of the system. If the difference between the desired pressure drops and mass flows are sufficiently small, it might even be possible to create a system always working with liquid only in the distribution pipe.

In another embodiment of the invention, shown in FIGS. 4*a* to 4*c* and FIGS. 5*a* and 5*b*, heat exchange between the liquid coolant from the condenser and coolant having a low pressure and consequently low temperature takes place in a tube placed near a distribution pipe according to what has been disclosed above.

Figure 4A:
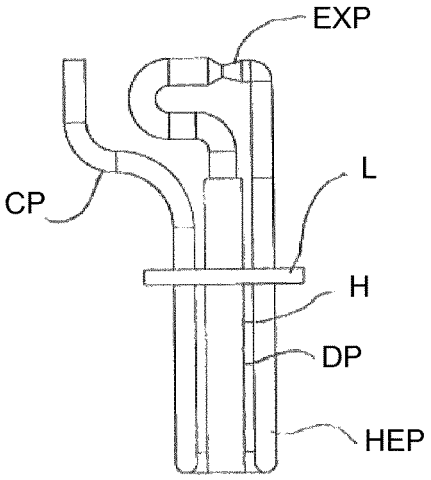
FIG. 4*a* is a plan view of a port arrangement according to one embodiment of the present invention.

With reference to FIG. 4*a*, a port opening arrangement including a distribution pipe DP having a multitude of holes H, a connection pipe CP, a lid L, a heat exchanging pipe HEP and an expansion valve EXP is shown in a side view. The same arrangement is shown in two perspective views in FIGS. 4*b* and 4*c*, where the design of the arrangement is more clearly shown. As can be seen in these figures, the connection pipe runs through the lid L, to a looping configuration LC, which is configured such that it turns the distribution pipe DP 180 degrees, such that the distribution pipe can extend through the lid L once more. After passing the lid, it reaches the expansion valve, makes another sharp U-turn, whereupon the distribution pipe runs through the lid L.

Figure 4B:
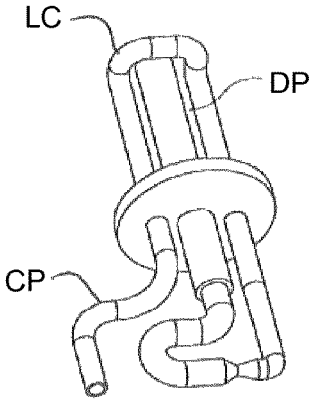
FIGS. 4*b* and 4*c* are perspective views of the port arrangement of FIG. 4*a;*
Figure 4C:
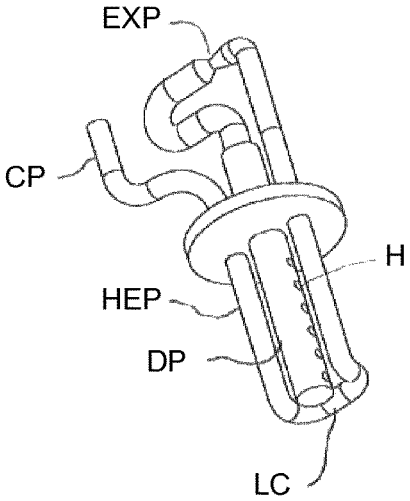
Figure 5A:
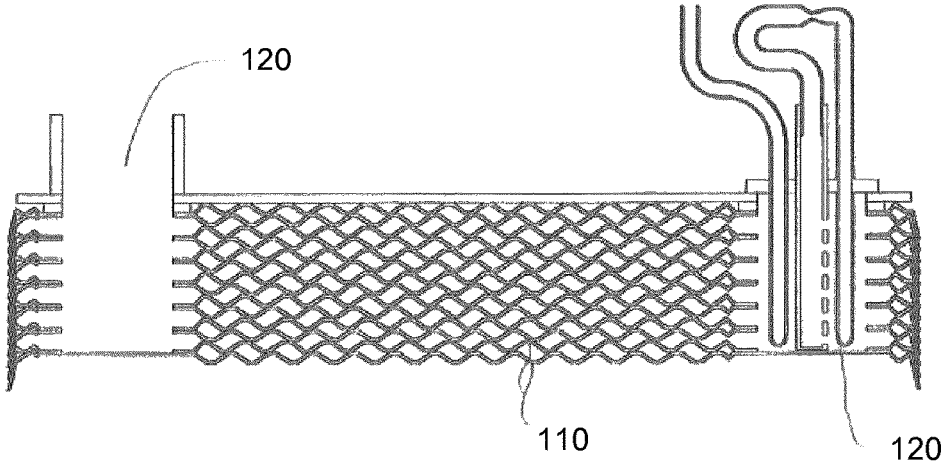
FIG. 5*a* is a section view of a heat exchanger having a port arrangement according to FIGS. 4*a*-4*c*, taken along the line A-A of FIG. 5*b;*
Figure 5B:
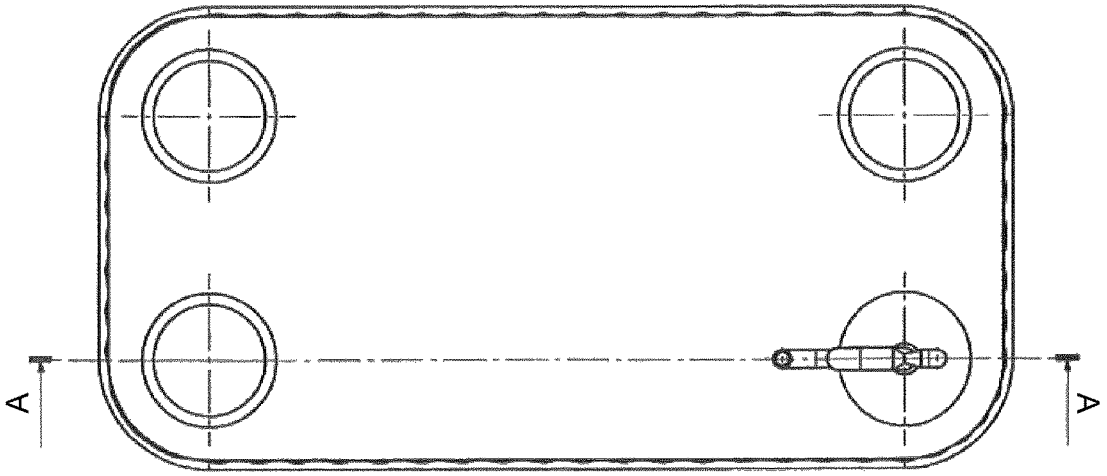
FIG. 5*b* is a plan view of a the heat exchanger of FIG. 5*a;*

During use, the port opening arrangement according to FIGS. 4*a*-4*c* is inserted into a heat exchanger of a known type, such as disclosed in FIGS. 5*a* and 5*b*. FIG. 5*a* is a section view of a plate heat exchanger, along the line A-A of FIG. 5*b* and includes the port openings 120 and heat exchanger plates 110.

The port opening arrangement according to the above may be fastened to the heat exchanger as a retrofit, but it is preferred to provide the port opening arrangement to the heat exchanger during the manufacturing. As mentioned above, a brazed plate heat exchanger is manufactured by placing heat exchanger plates provided with a pressed pattern of ridges and grooves in a stack, wherein a brazing material having a lower melting point than the material in the heat exchanger plates, place the stack in a furnace, heating the temperature of the furnace such that the brazing material melts and thereafter allow the heat exchanger plates to cool down. After the cooling down, the brazing material has solidified and will keep the plates together in contact points provided by the pressed patterns of the heat exchanger plates. The port opening arrangement can be brazed to the heat exchanger during this brazing process, but it can also be fastened to the heat exchanger after the heat exchanger has been brazed, e.g. by welding or soldering the lid to a top plate of the heat exchanger.

As could be understood, the distribution pipe of a port opening arrangement according to the above must have a distribution pipe having a smaller diameter than a distribution pipe of a prior art system, i.e. where no heat exchange is provided for in the port opening. This could potentially lead to a less favorable distribution due to pressure drop from the inlet of the distribution pipe to the end thereof, but this problem is mitigated by the aforementioned fact that the volume of the coolant entering the distribution pipe will be significantly smaller as compared to prior art solutions, i.e. where there is no cooling of the liquid coolant prior to entering the expansion valve.

As could be understood, there will be less heat exchange and hence higher temperature of the liquid coolant entering the expansion valve with the port opening arrangement compared to the heat exchanger with the pressed flow channels shown in FIG. 2. It is however possible to increase the heat exchanging of the port opening arrangement by leading the heat exchanging pipe back and forth along the distribution pipe four, six or even eight times without significantly increasing the diameter of the necessary port opening.

The port opening arrangement according to the above also makes it possible to manufacture a combined evaporator and condenser having a pipe leading from the condenser to the expansion valve through the port area of the evaporator, such that a heat exchange takes place between the coolant from the evaporator and the coolant after leaving the expansion valve.

Figure 6:
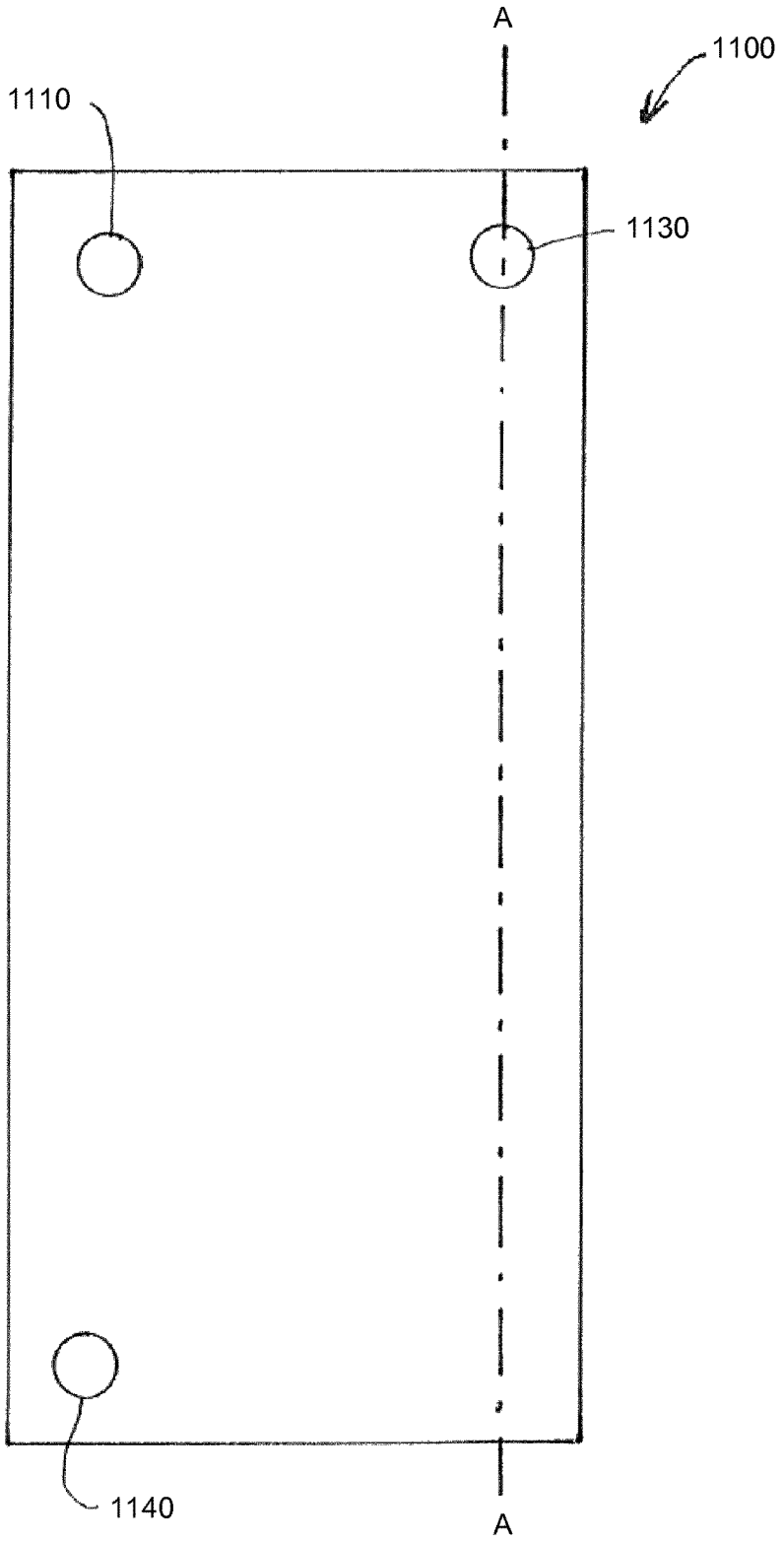
FIG. 6 is a plan view of a condenser side of a combined evaporator and condenser according to the present invention.

In FIG. 6, a front plate of a combined condenser and evaporator 1100 according to the present invention is shown. The combined condenser and evaporator 1100 is manufactured from a number of heat exchanger plates provided with a pressed pattern of ridges and grooves adapted to keep neighboring plates on a distance from one another under formation of interplate flow channels. Port openings are provided in the plates in order to allow for a fluid flow from outside the combined condenser and evaporator 1100 to the interplate flow channels. By providing plate areas around port openings on different heights, it is possible to achieve a selected communication, i.e. such that a port opening only communicates with some of the interplate flow channels. The edges of each plate are provided with skirts adapted to overlap with skirts of a neighboring plates to form a seal for the interplate flow channels. In order to keep the plates together and hermetically seal the heat exchanger flow channels, the plates are brazed in a furnace, i.e. heated such that a brazing material having a lower melting temperature than the plate material melts and joins the plates after cooling of. This technique for manufacturing brazed plate heat exchangers is well known by persons skilled in the art, and will hence not be further discussed.

With reference to FIG. 6, a condenser side of the combined condenser and evaporator 1100 comprises a coolant opening 1110 communicating with a first set of interplate flow channels 120 (see FIG. 3) and first 1130 and second 1140 heat carrier openings, both of which communicating with a second set of interplate flow channels 1150 (see FIG. 3). In use, the first and second heat carrier openings are preferably connected to a heating system of a building, and the coolant opening is connected to a high pressure side of the compressor.

Figure 7:
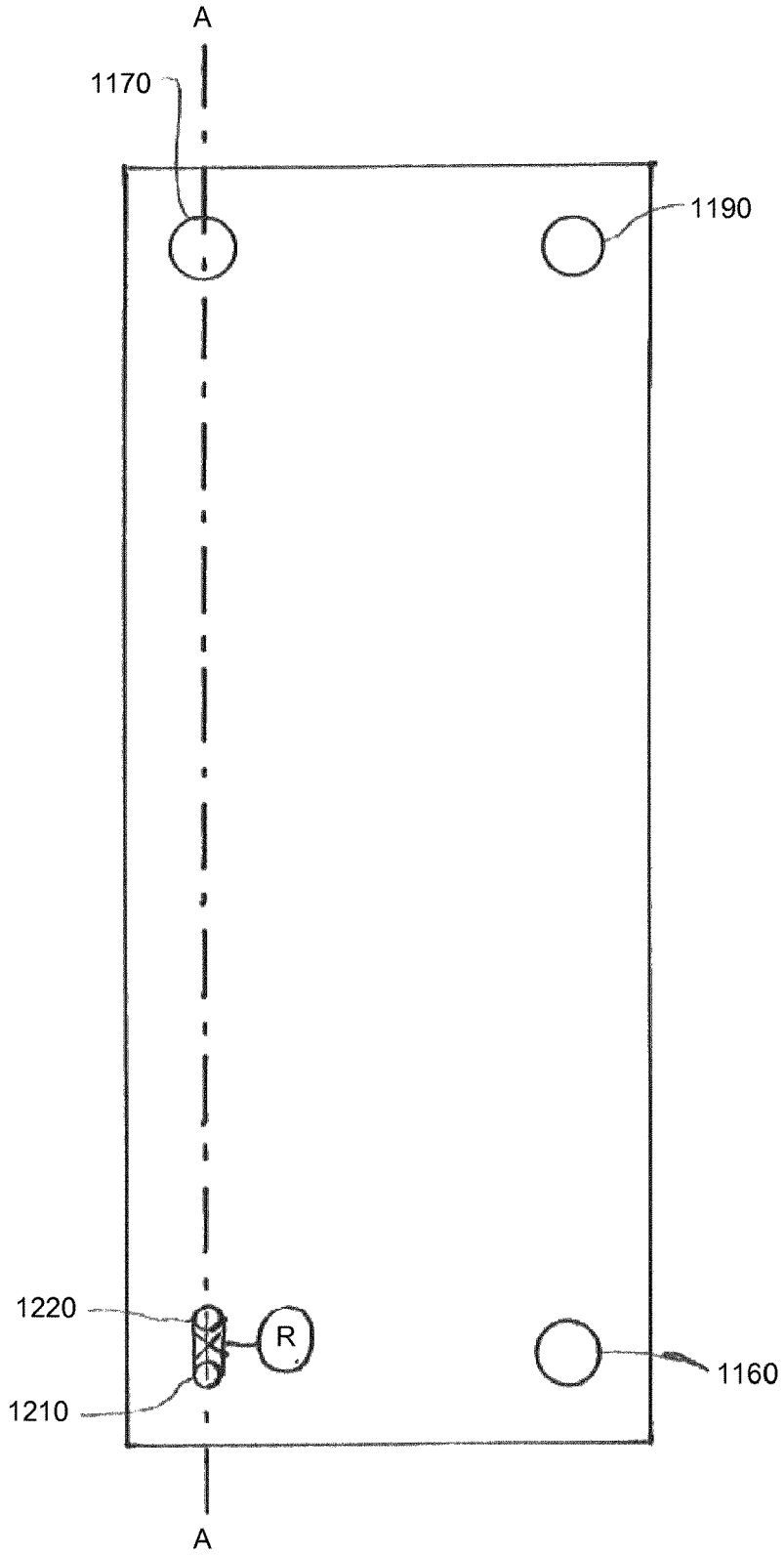
FIG. 7 is a plan view of an evaporator side of the combined evaporator and condenser of FIG. 6.

With reference to FIG. 7, an evaporator side of the combined condenser and evaporator 1100 comprises first 1160 and second 1170 brine openings, both of which communicating with a third set of interplate flow channels and a coolant outlet 1190, which communicates with fourth set of interplate flow channels 1200. Moreover, first 1210 and second 1220 coolant connections are shown, the function of which being described later, with reference to FIG. 7. During use, the first and second brine openings are connected to a brine system collecting low temperature heat from a low temperature heat source, the coolant outlet is connected to the low pressure side of the compressor, and the first and second coolant outlets are connected to one another via an expansion valve R.

Figure 8:
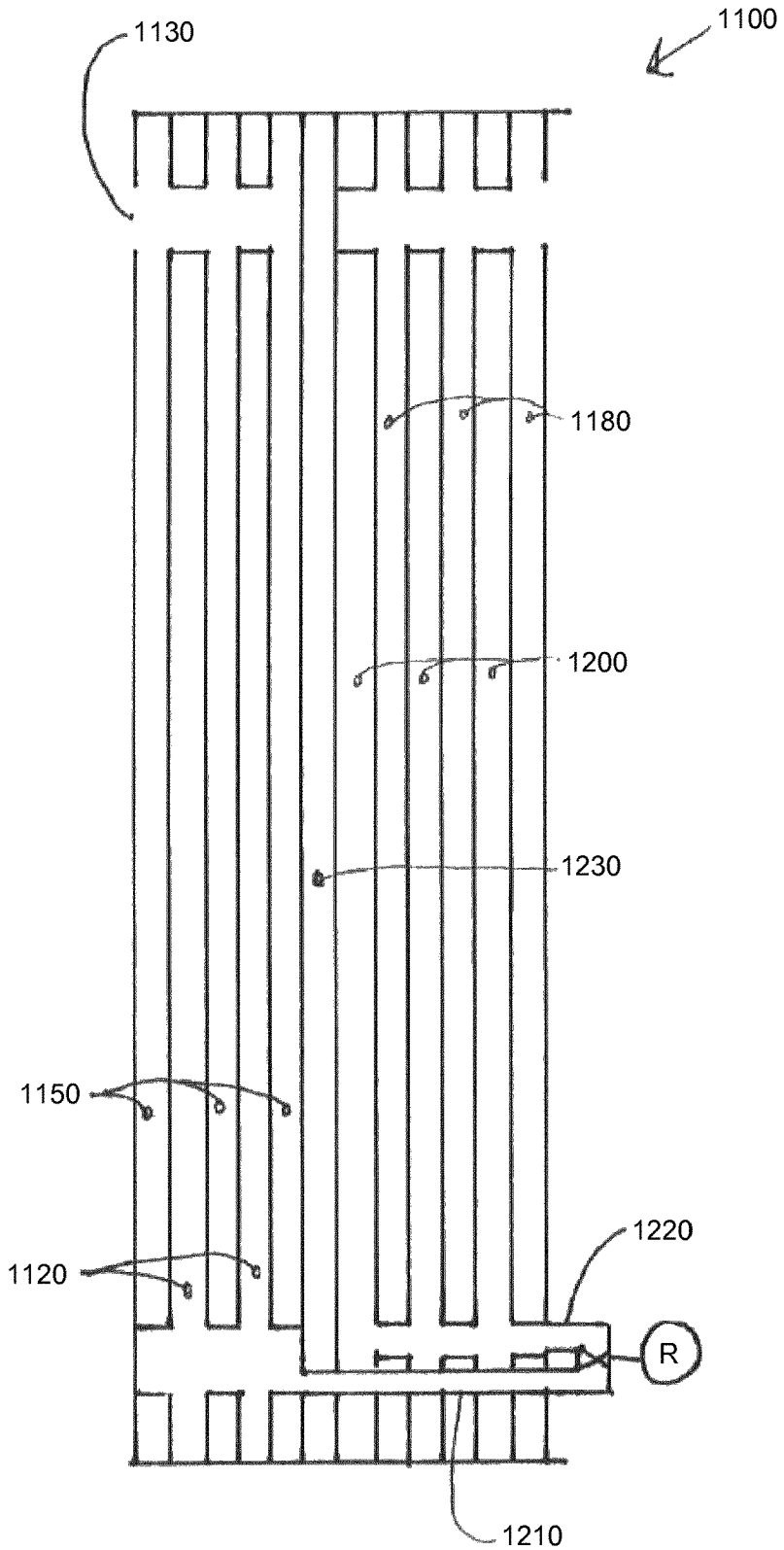
FIG. 8 is a section view taken along the line A-A of FIGS. 6 and 7.

FIG. 8 shows a section taken along the line A-A of FIGS. 6 and 7. Here, it is clearly shown that the interplate flow channels 1120 communicates with the pipe 1210, which leads from the interplate flow channels 1120 to the expansion valve R through the evaporator portion of the combined condenser and evaporator 1100, which comprises the interplate flow channels 1180 and 1200. At least one "blind" channel 1230 may be provided between the condenser portion and the evaporator portion. The purpose of this channel is to thermally insulate the condenser portion and the evaporator portion from one another, and the insulating properties are improved if the blind channel is arranged such that a vacuum from the brazing process (which often is performed in a furnace under vacuum) is retained in the blind channel.

In the embodiment of FIG. 8, the skirts surrounding the heat exchanger plates are all pointing in the same direction (toward the right), but in one embodiment of the invention, the skirts may point in one direction for the plates in the evaporator portion and in the other direction for the plates in the condenser portion.

When it comes to the pipe 1210, this pipe may be of any design. In one embodiment of the invention, the pipe 1210 is formed by providing port openings in the plates forming the interplate flow channels 1180, 1200 with skirts arranged to overlap one another, similar to how the edge portions of the plates are provided. Port openings of this type are described in European patent applications 09804125.4, 09795748.4 and 09804262.5.

It is also possible to provide an ordinary pipe between the interplate flow channels 120 to the expansion valve R through the evaporator portion.

In still another embodiment of the invention, which is useful if the system configuration makes it unnecessary with supercooling, it is possible to combine the two pipe configurations disclosed above, such that an ordinary pipe is located within a larger pipe made up from overlapping skirts. Just like in the case with the blind channel 1230, it is possible to design the pipes such that a vacuum is formed between the pipe made from the overlapping skirts and the ordinary pipe. By providing a vacuum between the pipes, there will be very good thermal insulation between the inner pipe (which leads liquid coolant from the interplate flow channels 1120 to the expansion valve R) and the evaporator (where low temperature semi-liquid coolant is present).

The pipe 1220 communicates with the interplate flow channels 1220, and provides these channels with low pressure semi-liquid coolant to be evaporated.

In some embodiments, it might be desired with a distribution pipe ensuring an even distribution of coolant into the interplate flow channels 1200; this may be achieved by a distribution pipe provided with small holes along its length, such that the holes will be aligned with the interplate flow channels 1200. An example of a distribution pipe design that could be used is disclosed in European patent application 08849927.2. In another embodiment, the distribution pipe is made up from overlapping skirts as disclosed above with reference to the European patent applications 09804125.4, 09795748.4 and 09804262.5, but provided with openings.

Above, the invention has been described with reference to specific embodiments; however, the invention is not limited to those embodiments, but can be varied within wide limits without falling outside the scope of the invention such as defined by the appended claims.

For example, the placement of the port openings for the respective media flowing in the interplate flow channels may be varied. According to the figures, all port openings are placed such that there is a crossflow configuration of the media, but this is not necessary nor possible in some cases. If identical plates are used for the condenser portion and evaporator portions of the combined condenser and evaporator 1100, it is for example necessary that there will be a parallel flow of the media exchanging heat. Such heat exchanger plates are necessarily provided with a herringbone pattern, and every other plate is turned 180 degrees in its plane compared to its neighboring plates.

Figure 9:
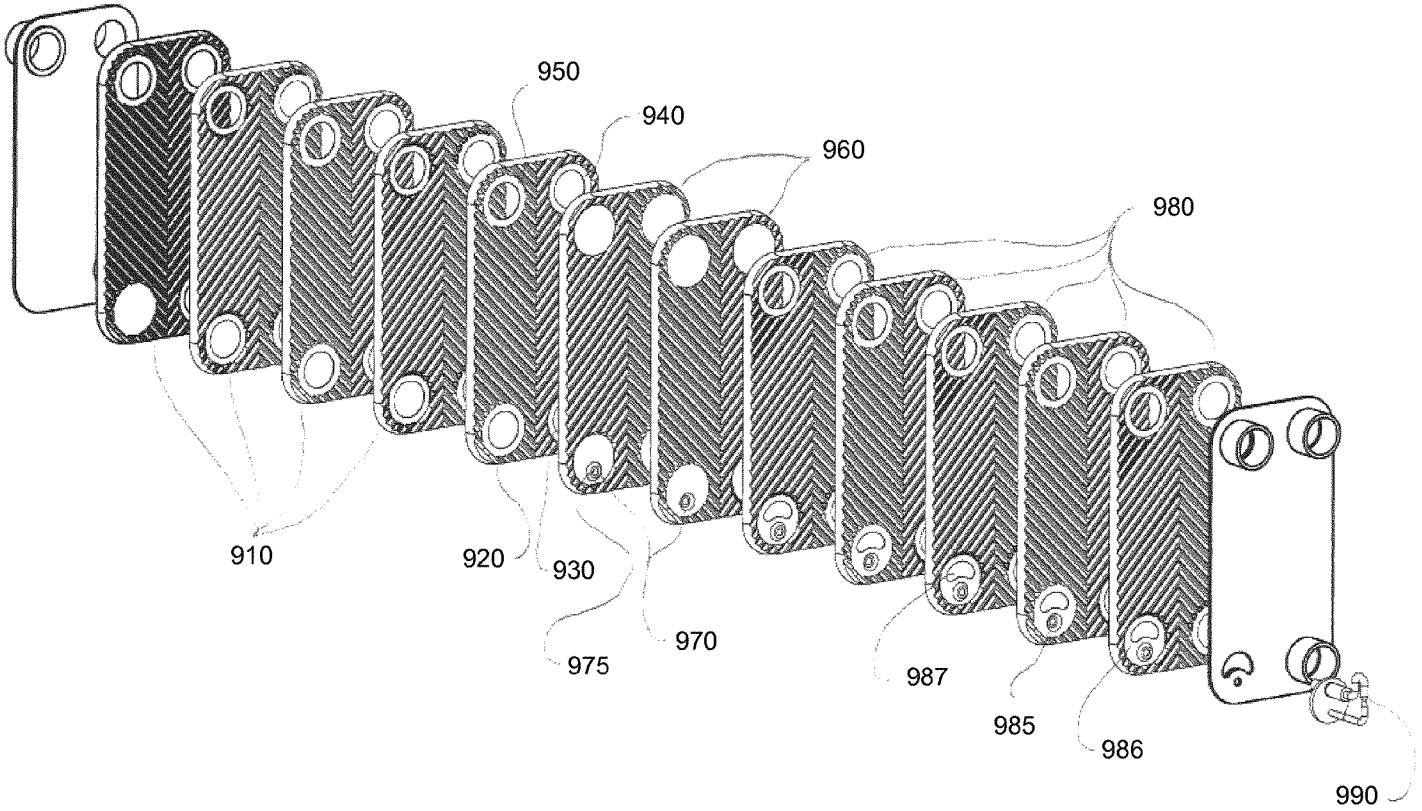
FIG. 9 is an exploded perspective view showing plates of a combined condenser and evaporator according to the present invention.

Still another embodiment of the invention is shown in FIGS. 9, 10*a* and 10*b*. This embodiment concerns a combined evaporator and condenser an comprises a number of condenser plates 910, each being provided with a pressed pattern of ridges and grooves for keeping the plates on a distance from one another under formation of interplate flow channels for media to exchange heat. Moreover, the condenser plates comprise four port openings 920, 930, 940 and 950 for selective communication between the interplate flow channels and the port openings. In the present case, the port opening 920 is an outlet opening for condensed coolant, the port opening 930 is an inlet for a high temperature heat carrier and the port openings 940 and 950 are inlets for gaseous coolant and outlet for high temperature heat carrier.

Two division plates 960 are provided between the condenser plates and an evaporator to be described below. The division plates 960 are similar to the condenser plates 920-950, but the port openings are not present on those plates, with an exception for small transfer channels 970 for condensed coolant. The transfer channels 970 have a frustum shape, wherein an upper area of the frustum is portly removed, such that an opening 975 is formed. The transfer channels on neighboring plates are provided in different directions; as can be seen in FIG. 9, the left transfer channel points to the right side, whereas the right transfer channel points to the left. When the distribution plates 960 are placed next to one another to form the stack of plates forming the combined condenser and evaporator according to this embodiment, the two transfer channels of the neighboring plates will contact one another and hence form a pipe having a serrated cross section.

The combined condenser and evaporator according to this embodiment also comprises a number of evaporator plates 980. The evaporator plates are practically identical to the condenser plates, except for one port opening 985, that differs significantly from the other port openings:

The port opening 985 comprises a base surface 986, which is arranged on alternating levels for neighboring plates; either on a low level or a high level. An opening 987 is provided in the base surface. Moreover, the base surface comprises transfer channels 970, and the transfer channels on the base surfaces point downwards on bases surfaces being provided on a high level and upwards on base surfaces provided on a low level.

When placed in the stack, the transfer cannels of neighboring plates will form a continuation of the pipe formed by the transfer channels on the intermediate plate. This pipe will extend through the entire stack of evaporator plates 980, whereas the base surfaces will form a selective communication between the openings 987 and interplate flow channels between the evaporator plates (the interplate channels between the evaporator plates are formed in the same fashion as the interplate channels in the condenser).

In use, liquid coolant from the condenser will flow through the transfer pipe through the stacked evaporator plates to an expansion valve 990, in which the pressure and the temperature of the coolant will be reduced. The low pressure, low temperature coolant will thereafter enter the openings 987, which as mentioned is in selective communication with interplate flow channels. The coolant will exchange heat with a fluid from a low temperature heat source and leave the evaporator fully vaporized, e.g. through an opening being placed on an opposite side of the evaporator. The heat exchanging function in an evaporator is well known by persons skilled in the art, and will hence not be more thoroughly described.

Just like in the previous embodiments, it is possible to provide a distribution pipe ensuring a proper distribution of coolant into the interplate channels in the openings 987.

Dimension and Materials.

The combined condenser and evaporator 1100 may be manufactured by any number of plates, but usually, more than two interplate flow channels of each type are provided. The size of the plates may be from 50 to 250 mm wide and from 100 to 500 mm high.

One preferred material for the plates is stainless steel, and the brazing material may be copper. The plates may have a thickness of 0.1 to 1 mm.

If the desired pressure during use is high, end plates may be provided to strengthen the combined condenser and evaporator 1100. Such end plates may be provided with a pressed pattern similar or identical to the plates limiting the interplate flow channels. Openings suitable for the purpose may also be provided in the end plates.

The invention claimed is:

1. A plate heat exchanger comprising a number of plates provided with a pressed pattern of ridges and grooves arranged to keep the plates on a distance from one another under formation of interplate flow channels for media to exchange heat with a heat exchange fluid, the interplate flow channels communicating with port openings, and the interplate flow channels include a first interplate flow channel and a second interplate flow channel, wherein the first interplate flow channel is constructed to flow one of the media or the heat exchange fluid therethrough, and the second interplate flow channel is constructed to flow another of the media or the heat exchange fluid therethrough so that the media and the heat exchange fluid do not contact each other, wherein one of the port openings is constructed for connection to a downstream side of an expansion valve such that coolant from the expansion valve may enter one of the interplate flow channels via the one port opening, and wherein a heat exchanging means is provided inside the one port opening, said heat exchanging means being arranged for exchanging heat between coolant downstream of the expansion valve and coolant about to enter the expansion valve.

2. The plate heat exchanger according to claim 1, wherein the heat exchanging means inside the one port opening is a pipe extending through the one port opening.

3. The plate heat exchanger according to claim 2, wherein the pipe extends from one end of the one port opening to another end of the one port opening.

4. The plate heat exchanger according to claim 1, wherein the heat exchanging means is provided by the pressed pattern in the heat exchanger plates.

5. The plate heat exchanger according to claim 4, wherein a ringlike area surrounding the one port opening is provided on a first level, whereas ringlike areas surrounding ports of the heat exchanging means are provided on a second level.

6. The plate heat exchanger according to claim 4, wherein an intermediate area extends around the one port opening, the intermediate area being provided at an intermediate level between the first and second levels.

7. The heat exchanger according to claim 6, wherein the intermediate area is surrounded by a blocking area, which is provided on the first level.

8. The heat exchanger according to claim 1, further comprising means for improving the distribution of coolant.

9. The heat exchanger of claim 8, wherein the means for improving the distribution of coolant is a distribution pipe comprising an elongate pipe provided with a multitude of holes aligned with the plate interspaces into which coolant can be fed.

10. The heat exchanger of claim 9, wherein the holes have such a dimension that they will give a sufficient pressure drop in operating conditions of a maximum mass flow and minimal temperature difference between the temperature of the condenser and the temperature of the evaporator.

11. The heat exchanger of claim 2, wherein the pipe extending through the one port opening runs through a lid.

* * * * *